United States Patent [19]

Cobb

[11] Patent Number: 4,554,971

[45] Date of Patent: Nov. 26, 1985

[54] TUBING ANCHOR ASSEMBLY

[76] Inventor: William O. Cobb, Rte. 4, Box 327, Haughton, La. 71037

[21] Appl. No.: 545,530

[22] Filed: Oct. 26, 1983

[51] Int. Cl.[4] ..... E21B 19/10

[52] U.S. Cl. ..... 166/88; 285/145

[58] Field of Search ..... 166/88, 75 R, 77, 379; 175/422; 285/144, 145; 188/67; 294/86.1, 102.2

[56] References Cited

U.S. PATENT DOCUMENTS

| | | | |
|---|---|---|---|
| 1,400,940 | 12/1921 | Clarke | 175/422 |
| 1,568,198 | 1/1926 | Tschappat | 294/102.2 |
| 3,090,640 | 5/1963 | Otteman et al. | 285/145 |
| 3,287,035 | 11/1966 | Greenwood | 166/88 |
| 4,326,587 | 4/1982 | Gauthier et al. | 166/379 |
| 4,334,342 | 6/1982 | Hall | 285/144 |

FOREIGN PATENT DOCUMENTS

| | | | |
|---|---|---|---|
| 0650818 | 10/1962 | Canada | 175/422 |

*Primary Examiner*—Stephen J. Novosad
*Assistant Examiner*—William P. Neuder
*Attorney, Agent, or Firm*—John M. Harrison

[57] ABSTRACT

A tubing anchor assembly for seating and supporting coiled tubing in a tubing head, which includes as a first element, multiple slip segments inserted in the slip bowl of the tubing head and each provided with a vertically oriented dove tail slot, and as a second element, slip retainer screws radially threaded in the tubing head body at spaced intervals, each of the slip retainer screws provided with a frustro conical tip extending into the slip bowl of the tubing head and engaging a dove tail slot in one of the slip segments. The slip segments are maintained in open configuration inside the upper portion of the slip bowl when the slip retainer screws are in engagement with the dove tail slots and are threadably retracted in the tubing head body with the frustro conical tips adjacent the side of the slip bowl. A retainer ring located in a groove provided in each of the slip segments serves to maintain the slip segments in a desired alignment inside the slip bowl and the slip segments are permitted to drop in concert by the influence of gravity from the frustro conical tips of the slip retainer screws as the slip retainer screws are caused to threadably travel toward the tubing into the slip bowl.

25 Claims, 8 Drawing Figures

TUBING ANCHOR ASSEMBLY

BACKGROUND OF THE INVENTION

1. Field of the Invention

This invention relates to devices and equipment for suspending tubing in an oil or gas well and more particularly, to a new and improved tubing anchor assembly for suspending coiled or conventional tubing in a well without the necessity of "killing" the well. The tubing anchor assembly of this invention is characterized by multiple, shaped slip segments located in the slip bowl of a conventional tubing head, each of the slip segments provided with a vertically oriented dove tail slot which cooperates with the frustro conical tip of a slip retainer screw threaded in the tubing head and projecting into the slip bowl, to facilitate release of the slip segments after a length of tubing has been inserted into the well, in order to support the tubing in the well.

As the down-hole pressure in oil and gas wells decreases with time, it is sometimes desirable or necessary to insert tubing in the well in order to provide a means for more readily removing fluids from the well and prolonging the life of the well. Traditionally, it has been necessary to "kill", or terminate production by application of hydrostatic pressure in the well in order to achieve this objective. The well is "killed", or production is terminated from the well by pumping a fluid such as water into the producing interval to create a hydrostatic head in the well of sufficient magnitude to overcome the well pressure, thereby terminating production. One of the problems inherent in "killing" a producing well which is characterized by relatively low pressure, is the difficulty and sometimes impossibility, of restoring the well to production after the desired swabbing or cleaning operation has been accomplished. Such cleaning and swabbing and other well maintenance operations are expensive, generally because of the time required to remove the Christmas tree, set up the necessary apparatus for maintaining the well, placing tubing in the well, where such tubing is deemed necessary, placing a tubing head on the master valve, setting the slip segments and the necessary packing, replacing the Christmas tree and then attempting to bring the well back into production. It is apparent that if the well cannot be brought back into production, then the time and money expended for placing the tubing in the well, as well as the maintenance effort, has been wasted.

2. Description of the Prior Art

Slip assemblies and related equipment have been employed for many years in the oil field for suspending pipe and tubing in oil and gas wells. Such assemblies usually consist of multiple, segmented wedges which are tapered and are provided with horizontally extending teeth located on curved inner surfaces, which teeth are designed to engage and cut into the pipe or tubing to prevent relative movement between the tubing and the slips. The slips are wedged-shaped and curved in order to conform to the shape of a tapered, usually conical slip bowl provided in a tubing head, in order to facilitate engagement of the slips radially about the pipe or tubing when the slips are released inside the slip bowl responsive to contact between the wedge-shaped rear surfaces of the slips and the slip bowl in the tubing head. Lowering of the pipe or tubing after release of the slips results in a radial compressive force which urges the segments against the pipe or tubing until the teeth cut into the pipe or tubing wall sufficiently to support the weight of the tubing in the tubing head. Generally speaking, the teeth provided in the curved inner face of each slip segment are configured and oriented to engage and cut into the pipe or tubing in an optimum manner, to prevent relative movement between the slip segments and the suspended pipe or tubing.

Various devices have been known in the prior art for supporting casing and tubing in oil and gas wells. An early "Pipe Holding Device" is disclosed in U.S. Pat. No. 1,836,596 dated Dec. 15, 1931, to J. E. Hoffoss, et al. The "Pipe Holding Device" of this patent includes a single slip which is adapted to entirely surround the pipe and the device includes multiple jaws so mounted and constructed that they can be handled by one workman to engage the pipe uniformly and evenly on all sides. U.S. Pat. No. 3,051,513 to J. D. Watts, et al, dated Aug. 28, 1962, discloses a "Hanger Assembly and Seal Therefor", which includes a wrap-around hanger assembly having upper and lower segmental members cooperating to define a tubing support bowl and a casing head engaging ring, respectively. The segmental members forming the bowl and ring are interconnected in pairs by an improved construction which provides limited vertical movement between the ring and bowl and allows relative rotational movement between these two elements. A "Slip Assembly" is disclosed in U.S. Pat. No. 2,874,436 dated Feb. 24, 1959, to H. Allen. The "Slip Assembly" of this invention is characterized by a slip bowl constructed in two sections, each of which is substantially semicircular in configuration, in order to permit separation for ease of placing the assembly in position around a pipe to be suspended. Semicircular portions of the bowl are secured around the pipe by cap screws and define a bowl which is in effect, a complete circular structure having an outer tapered surface and an inner tapered surface which are substantially parallel to each other. A plate which serves as a slip retainer is also provided on lateral edges of the slip bowl segment. A "Casing Hanger and Stabilizer" is disclosed in U.S. Pat. No. 4,334,342 dated June 15, 1982, to Gregory G. Hall, which device includes a pair of generally wedge-shaped slip segments having mating faces and removably joined at the faces by a pair of plates. The device is further provided with interior slip threads or teeth for engaging the surface casing and a plurality of slots in the longitudinal exterior surface to permit the pumping of drilling mud or other fluid between the supporting conductor pipe and the suspended surface casing prior to cementing the surface casing in the conductor pipe.

U.S. Pat. No. 2,887,754 dated May 26, 1959, to C. F. Johnson details a "Pipe Anchor" for suspending pipe in a well which includes a support with a central opening for the pipe, wedges disposed in a conical bowl in the support and screws inserted in the support wall and engaging the wedges, which screws are sheared when the wedges are forced downwardly against a length of pipe inserted for suspension in the support.

It is an object of this invention to provide a new and improved tubing anchor assembly for suspending tubing in a well in a safe, fast, efficient and cost effective manner without the necessity of reducing production pressure in the well prior to insertion of the tubing.

Another object of this invention is to provide a tubing anchor assembly for suspending tubing in an oil or gas well, which assembly is characterized by multiple slip segments, each having a dove tail slot provided therein for engagement with the shaped end of one of several slip retainer screws which are threaded radially in a tubing head to facilitate controlled release of the slip segments in the slip bowl of the tubing head to support tubing placed in the well while production pressure is maintained in the well.

Yet another object of this invention is to provide a new and improved tubing anchor assembly for use in tubing heads to suspend tubing in oil and gas wells without "killing" the wells, which assembly includes as a first element, multiple slip segments clustered in a slip assembly by a retainer ring and disposed in the slip bowl of the tubing head, each of which slip segments is provided with a dove tail slot in the rear surface thereof and as a second element, slip retainer screws radially threaded in the tubing head wall and extending into the slip bowl and engaging the slots in the slip segments, to selectively release the slip segments in concert and support the tubing after the tubing is run into the well.

Yet another object of this invention is to provide a tubing anchor assembly for use in conventional tubing heads, which assembly includes at least two slip segments loosely joined by a ring and having vertically oriented dove tail slots provided in the outside surfaces thereof and positioned in the slip bowl of the tubing head and a slip retainer screw for each slip segment, which slip retainer screws are threadably and radially pressure sealed in the tubing head and are each provided with a frustro conical tip which extends into the slip bowl and engages a dove tail slot in the slip segments to selectively retain the slip segments in the slip bowl of the tubing head and threadably extend the slip segments into the slip bowl and allow the slip segments to release from the frustro conical tips of the slip retainer screws by operation of gravity, to engage and support the tubing in the tubing head while pressure is maintained in the well.

SUMMARY OF THE INVENTION

These and other objects of the invention are provided in a new and improved tubing anchor assembly which in a preferred embodiment is characterized by multiple wedge-shaped slip segments positioned in the slip bowl of a tubing head, each of the slip segments provided with a horizontal groove and a vertically oriented dove tail slot in the rear surface thereof, the dove tail slot extending to the groove, and multiple slip retainer screws radially threaded in the tubing head and fitted with frustro conical tips extending into the slip bowl for engaging the dove tail slots in the slip segments, to facilitate the support of coiled tubing in a well without reducing pressure in the well by manipulating the slip segments toward the tubing through threadable manipulation of the slip retainer screws to cause release of the slip segments from the frustro conical tips of the retainer screws and engagement of the tubing by the slip segments.

BRIEF DESCRIPTION OF THE DRAWING

The invention will be better understood by reference to the accompanying drawings wherein.

DESCRIPTION OF THE PREFERRED EMBODIMENTS

Figure 1:
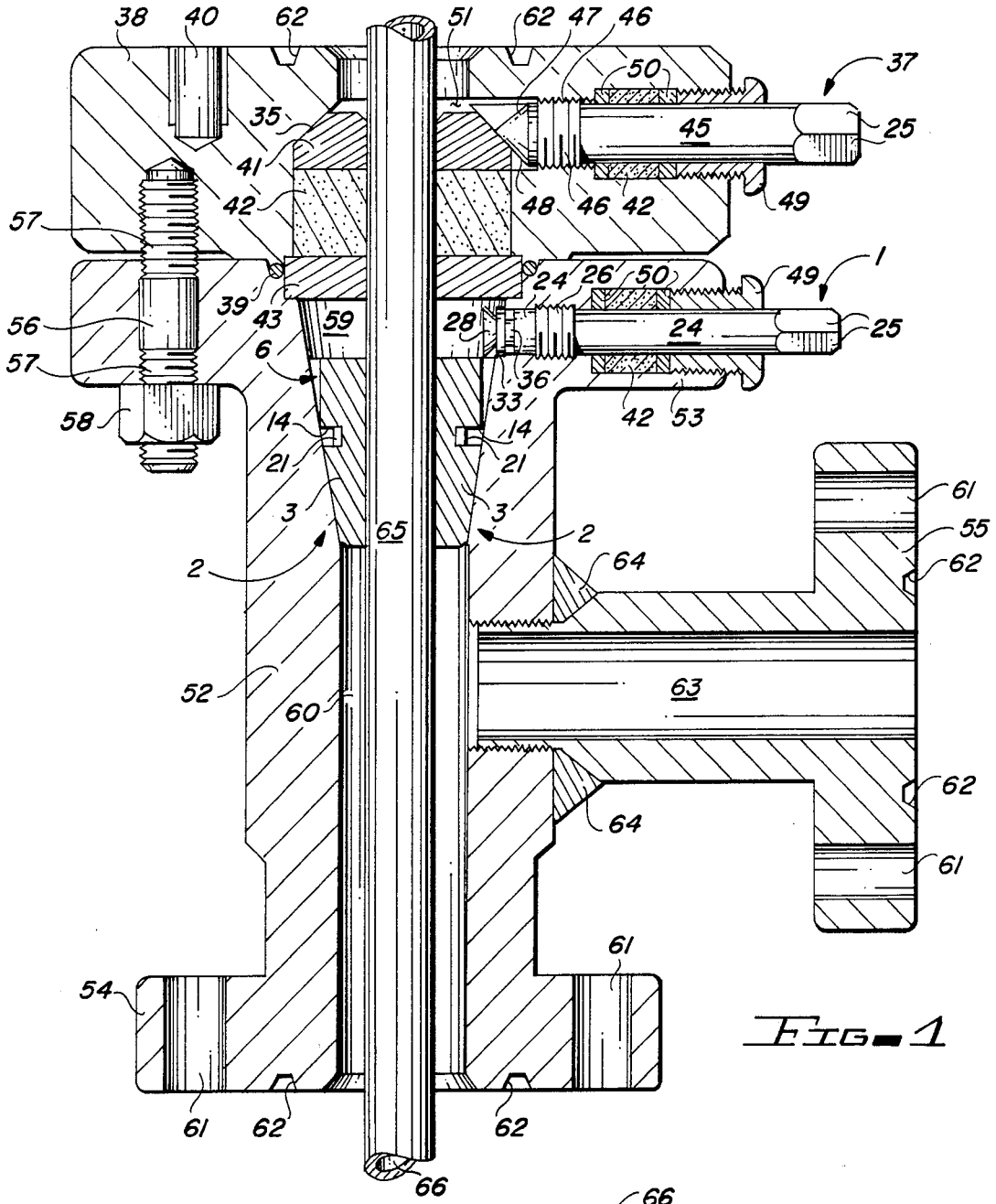
FIG. 1 is a sectional view of a tubing head with the tubing anchor assembly in functional position engaging and supporting a length of tubing.
Figure 2:
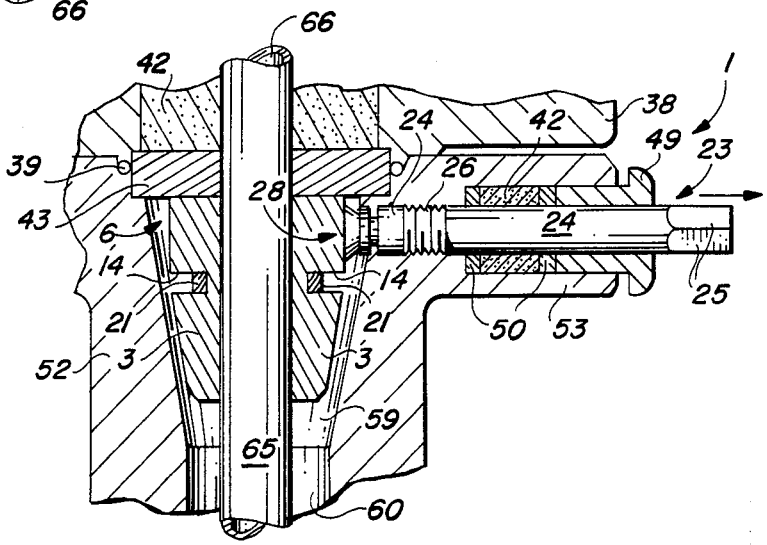
FIG. 2 is a sectional view of the tubing head illustrated in FIG. 1, more particularly illustrating the open position of the slip segments prior to engagement with the tubing.
Figure 5:
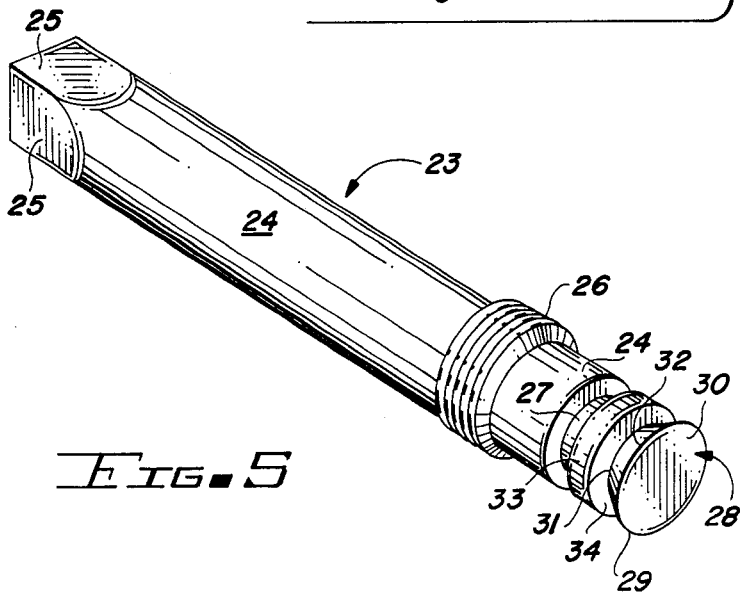
FIG. 5 is a perspective view of a preferred slip retainer screw which is used for supporting the slip segments in the slip bowl of the tubing head.

Referring initially to FIGS. 1, 2 and 5 of the drawings, the tubing anchor assembly of this invention is generally illustrated by reference numeral 1, and includes multiple slip retainer screws 23, the retainer screw shanks 24 of which are each threadably and radially spaced and seated in the tubing head body 52 of a conventional tubing head 37, by means of shank threads 26. The frustro conical tip 28 of each of the slip retainer screws 23 projects inside a slip bowl 59 in the tubing head 37 and is attached to a guide flange 33 at a tip recess 31, as is more particularly illustrated in FIG. 5 of the drawings. The slip retainer screws 23 are each sealed in the top flange 53 of the tubing head 37 by means of a retainer screw O-ring 36, fitted in an O-ring groove 27 and by a gland nut 49, which is threadably inserted in an internal thread aperture [not illustrated] in the top flange 53. A pair of packing rings 50, spanning a supply of packing 42 and cooperating with the gland nut 49, serve to seal the retainer screw shank 24 against well pressure in the slip bowl 59. Similarly, referring again to FIG. 1 of the drawings packing screws 44, each having a packing screw shank 45 fitted with packing screw threads 46, are threadably and radially inserted in spaced relationship in a pack-off flange 38, mounted on the top flange 53 in the tubing head 37. Each packing screw shank 45 is sealed in the pack-off flange 38 by another gland nut 49, engaging the first of a pair of spaced packing rings 50 and including a quantity of packing 42 disposed between the packing rings 50. The packing screw head 47 of the packing screw 44 is tapered to define a bevelled face 48, which is in contact with a matching junk ring face 35 of an upper junk ring 41, provided in the packing bore 51 of the pack-off flange 38, in order to compress the upper junk ring 41 against a quantity of packing 42, also disposed in the packing bore 51 and supported by a lower junk ring 43, which is positioned adjacent and above the slip bowl 59. Accordingly, it will be appreciated that as the packing screws 44 are rotated in the clockwise direction by placing a wrench on the wrench flats 25, provided in the packing screw shank 45, the upper junk ring 41 is forced against the packing 42 and the packing 42 is squeezed between the upper junk ring 41 and the lower junk ring 43 and against the tubing 65, to seal the packing bore 51 from fluid pressure in the tubing head 37.

The pack-off flange 38 is joined to the top flange 53 of the tubing head 37 by means of a top flange stud 56, provided with stud threads 57 and a stud nut 58 secured to the lower array of stud threads 57, as illustrated. A flange O-ring 39 is positioned between the pack-off flange 38 and the top flange 53, to seal the packing bore 51 and the slip bowl 59, and pack-off flange apertures 40, provided in the pack-off flange 38 are internally threaded to facilitate mounting a valve or other equipment on the pack-off flange 38. A bottom flange 54 is also provided on the tubing head body 52 and is fitted with flange apertures 61, for flanging to a master valve in a "Christmas Tree" system, according to procedures well known to those skilled in the art. A flanged outlet 55 is also provided in the tubing head body 52 at a point intermediate the top flange 53 and the bottom flange 54 and, like the pack-off flange 38 and the bottom flange 54, is fitted with O-ring seats 62, for sealing a connection with a production or other line [not illustrated] which may extend from the flanged outlet 55. It will be appreciated that the outlet bore 63 of the flanged outlet 55, communicates with the bore 60 in the tubing head body 52, in order to facilitate the flow of hydrocarbons and well fluid from the well through the bore 60 and the outlet bore 63 to a pipeline or storage facility, as desired. It will be further appreciated that fluids can also be pumped in the reverse direction through the outlet bore 63 and the bore 60 and into the well, as deemed necessary by those skilled in the art. The flanged outlet 55 is typically attached to the tubing head body 52 by means of a weld 64.

Referring again to FIG. 1 of the drawings a length of tubing 65, having a tubing bore 66, is illustrated extending through the packing bore 51 of the pack-off flange 38 and the slip bowl 59, of the top flange 53 and into the well through the bore 60. As a first element of the tubing anchor assembly of this invention, slip segments 2 are illustrated in functional configuration positioned in the lower end of the slip bowl 59 and engaging the tubing 65 to support the tubing 65 in the slip bowl 59 and the bore 60 of the tubing head 37.

Figure 3:
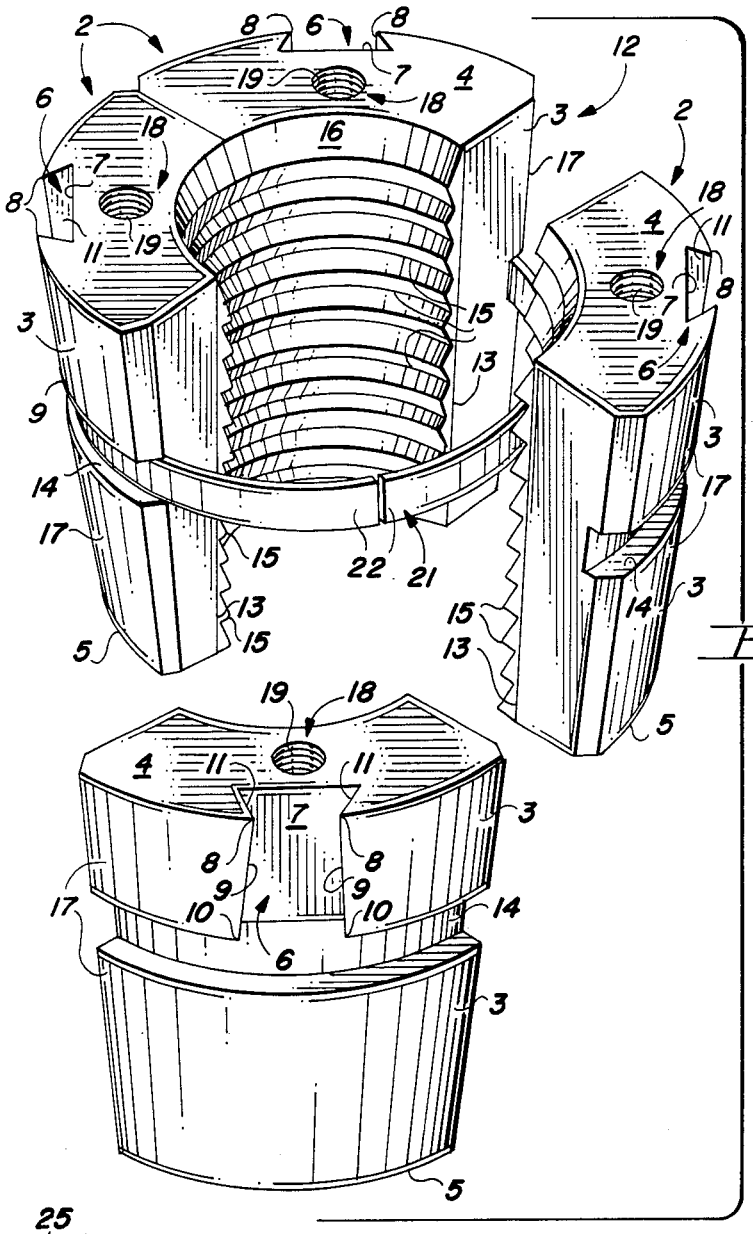
FIG. 3. is perspective, partially exploded view of a preferred slip assembly according to this invention.
Figure 6:
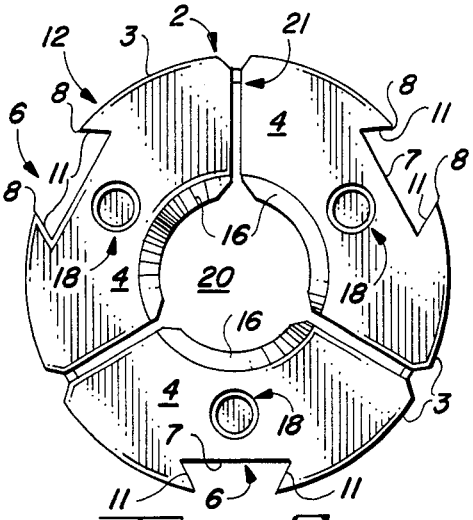
FIG. 6 is a plan view of three slip segments assembled as a slip assembly, in open configuration.

Referring now to FIGS. 3, 5 and 6 of the drawings in a preferred embodiment of the invention the slip segments 2 are each designed with a tapered body portion 3, having a retainer ring groove 14 laterally disposed across the outside surface thereof intermediate the top face 4 and the bottom edge 5 of the slip segment 2. A dove tail slot 6 is provided in the approximate center of the upper segment of the body portion 3 and extends between the top face 4 and the retainer ring groove 14. The dove tail slots 6 are each further characterized by a slot base 7, which is vertically oriented when the slip segments 2 are in the position illustrated in FIGS. 1 and 2 of the drawings and the slot base 7 is parallel to the inner edges 13, of the body portion 3. The top shoulders 8 define the maximum depth of the dove tail slots 6, which depth varies along the length of the dove tail slots 6 and is equal to the varying width of slot sides 11. Slot edges 9 extend between the top shoulders 8 and bottom shoulders 10, respectively, in spaced relationship, as illustrated in FIG. 3. Since each of the slip segments 2 are provided with a downward vertical taper 17 on the outer portion of the body portion 3 between the top face 4 and the bottom edge 5, the distance between the top shoulders 8 is less than the distance between the bottom shoulders 10 and the slot edges 9 diverge from the top shoulders 8 to the bottom shoulders 10. Furthermore, in another preferred embodiment, the slot sides 11 are at a maximum width at a point between the top shoulders 8 and the slot base 7 and taper to a point at the bottom shoulder 10, as a result of the vertical taper 17, when the angle of taper of the vertical taper 17 is about 9.5 degrees, which matches the taper of the slip bowl 59. Each of the slip segments 2 are further provided with multiple teeth 15, shaped in the concave inner surface of the body portion 3 between the inner edges 13 and each top face 4 is provided with a slip aperture 18 which is fitted with internal slip aperture threads 19, to facilitate the location of threaded studs in the slip segments 2 in order to remove the slip segments 2 from the position illustrated in FIG. 1 when it is desired to dismantle the tubing anchor assembly 1. Each of the slip segments 2 is further provided with a top bevel 16, extending from the top face 4 downwardly to shape the first of the teeth 15 in the curved inside surface of the body portion 3.

Referring now to FIGS. 3 and 6 of the drawings, and initially to FIG. 3, four slip segments 2 are assembled in close proximity to shape a round slip assembly 12, disposed in open configuration, and an open retainer ring 21, having retainer ring ends 22, is expanded over the bottom edges 5 of the slip segments 2 and inserted in the retainer ring groove 14, to maintain the four slip segments 2 approximately in alignment with each other and to shape the slip assembly 12. As illustrated in FIG. 6, it will be appreciated by those skilled in the art that various numbers of the slip segments can be used to shape the slip assembly 12 in the tubing anchor assembly 1 and the three slip segments 2 illustrated therein are also joined by a retainer ring 21 in the loose, open configuration illustrated. Various other combinations of slip segments 2, ranging from two such slip segments 2 upward, can be utilized in the tubing anchor assembly of this invention according to the knowledge of those skilled in the art. It will be further appreciated from a consideration of the four slip segments 2 illustrated in FIG. 3 and the three slip segments 2 illustrated in FIG. 6, that the retainer ring 21 is fitted in the retainer ring groove 14 with sufficient tension to prevent any of the slip segments 2 from slipping out of the slip assembly 12, but sufficiently loose to allow relative radial movement of the slip segments 2 with respect to each other, as hereinafter described.

Figure 4A:
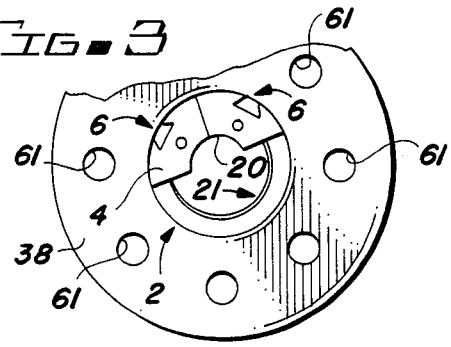
FIG. 4*a* is a plan view, partially in section, of the tubing head with two slip segments in functional, closed position in the slip bowl.
Figure 4B:
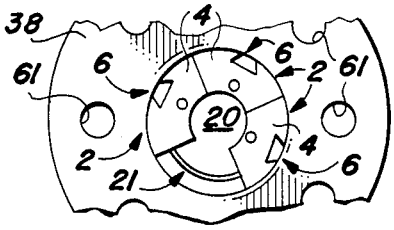
FIG. 4*b* is a plan view, partially in section, of the tubing head with three of the four slip segments in functional, closed position in the slip bowl.
Figure 4C:
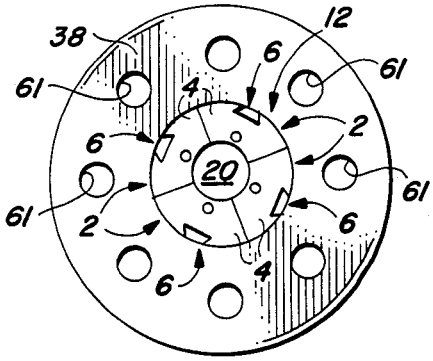
FIG. 4*c* is a plan view of the four slip segments which comprise a slip assembly, in functional, closed position in the slip bowl.

Referring now to FIGS. 1, 2 and **4*a*–4*c* of the drawings and initially to FIGS. 1 and 4*a*–4*c*, the relative positions of the slip segments 2 inside the slip bowl 59 of the tubing head 37 and in engagement with the retainer ring 24 are illustrated in closed, supporting configuration to more particularly detail a slip assembly 12, which is illustrated in completed orientation in FIG. 4*c*. When the slip assembly 12 is completed, a slip bore 20 is defined by the curved teeth 15 of the slip segments 2. Furthermore, when the slip assembly 12 is placed in the slip bowl 59 of the tubing head 37 with a frustro conical tip 28 of each slip retainer screw 23 in registration with a dove tail slot 6 in a cooperating one of the slip segments 2, respectively, the slip segments 2 are suspended in the slip bowl 59 as a slip assembly 12 in open configuration, as illustrated in FIG. 2. Accordingly, the tubing 65 is then easily inserted through the slip bore 20 of the slip assembly 12, through the bore 60 of the tubing head 52** and into the well, as hereinafter described.

Referring again to FIGS. 3 and 5 of the drawings in a most preferred embodiment of the invention, each slip retainer screw 23 is threaded in the top flange 53 of the tubing head 37 in horizontal configuration and in perpendicular orientation with respect to the vertically positioned tubing 65. Furthermore, each frustro conical tip 28 is provided with a flat tip base 30, defined by a round tip shoulder 29, which tip base 30 engages the slot base 7 in the dove tail slot 6 of a slip segment 2, such that the inner edges 13 of each of the slip segments 2 project substantially vertically downwardly in the slip bowl 50, and generally parallel to the tubing 65. Accordingly, referring again to FIGS. 1 and 2 of the drawings when the tubing head 37 is oriented as illustrated, with the tubing 65 inserted therein in vertical relationship, the retainer screw shank 24 of the slip retainer screw 23 is in horizontal disposition with respect to the inner edges 13 and the slot base 7, of a cooperating slip segment 2. Furthermore, referring to FIG. 5, the tip sides 32 of each of the frustro conical tips 28 are bevelled from the tip shoulder 29 to the tip recess 31 and the angle of bevel conforms substantially to the angle of bevel of the slot sides 11 in the dove tail slots 6, with sufficent clearance provided between the tip base 30 and the slot base 7 to facilitate sliding movement of the frustro conical tips 28 in the dove tail slots 6, respectively. Accordingly, as a frustro conical tip 28 engages a dove tail slot 6 and the tip sides 32 engage the slot sides 11, the common angle of bevel in the slot sides 11 and the cooperating tip sides 32 and the close proximity of the tip base 30 to the slot base 7, serve to maintain essentially perpendicular alignment between the slip retainer screws 23 and the slot base 7 of each dove tail slot 6. This alignment also facilitates substantially vertical orientation of the inner edges 13 of the slip segments 2 in the slip bowl 59 and the alignment is important, since the slip segments 2 must be free to slide in concert as a slip assembly 12 from engagement with the slip retainer screws 23 at the proper time, to engage and support the tubing 65 in the tubing head 37. Accordingly, referring again to FIGS. 2 and 6, when the slip segments 2 are initially placed in the slip bowl 59, the slip retainer screws 23 have already been threadably retracted in the top flange 53 to the point where the frustro conical tips 28 are adjacent the wall of the slip bowl 59. When the slip retainer screws 23 are in this retracted position, the slip segments 2 in the slip assembly 12 can be manipulated such that each dove tail slot 6 is engaged with the frustro conical tip 28 of a cooperating slip retainer screw 23 and the slip assembly 12 is prevented from dropping further into the slip bowl 59 by the close proximity of the frustro conical tips 28 to the wall of the slip bowl 59. Accordingly, the slip segments 2 are constrained in concert as a slip assembly 12, to remain in the position illustrated in FIGS. 2 and 6, to define a slip bore 20 which is sufficiently large to permit the insertion of tubing 65 therethrough, in order to position the tubing 65 in the well.

In operation, referring again to FIGS. 1, 2 and 6 of the drawings, under circumstances where it is desired to insert a length of tubing 65 into a well without reducing the pressure or "killing" the well, the master valve [not illustrated] in a conventional Christmas tree [not illustrated] is initially closed. The Christmas tree is then removed from the master valve and if the well is not equipped with a tubing head, a tubing head 37 is then installed on the master valve in place of the Christmas tree by inserting bolts through the flange apertures 61 in the bottom flange 54 and bolting the bottom flange 54 to the top flange of the master valve. It will be appreciated that the tubing head 37 which is so installed on the master valve is equipped with multiple slip retainer screws 23, extending radially in spaced relationship from the top flange 53 of the tubing head 37, as illustrated in FIG. 1. Slip segments 2, which have been assembled to define a slip assembly 12, are provided with a cooperating retainer ring 21 and are suspended from the frustro conical tips 28 of the slip retainer screws 23 by engaging the dove tail slots 6 with the frustro conical tips 28, respectively, as illustrated in FIG. 2. This configuration of the slip segments 2 creates a slip bore 20 which is sufficiently large to permit the tubing 65 to be inserted entirely through the center of the tubing head 37, as illustrated in FIG. 6 of the drawings. The tubing 65, which is typically wound on a drum positioned in cooperation with a tubing running unit [not illustrated] designed to insert the tubing 65 in a well, is then positioned near the well location and an appropriate blowout preventer system [not illustrated] is mounted on the tubing head 37 in association with the tubing 65, in accordance with procedures well known to those skilled in the art. The tubing running unit is then set up for inserting one end of the tubing 65 into the well and the well is "packed off" or sealed above the blowout preventers in order to prevent the working pressure in the well from escaping around the tubing 65 when the tubing 65 is inserted in the tubing head 37. The inserted end of the tubing 65 is first closed by means of a plug and the plugged end of the tubing 65 is extended through the packing bore 51 of the pack-off flange 38 and the slip bore 20 of the slip assembly 12, to the closed master valve. The packing in the tubing running unit is then tightly compacted, the master valve opened and the tubing 65 unwound from the drum and extended into the well to the desired depth.

When the tubing 65 has been inserted in the well to the desired depth and while it is supported by the tubing running unit, the slip assembly 12 is released from the respective frustro conical tips 28 of the retainer screws 23, by placing a wrench on the wrench flats 25 of each retainer screw shank 24 and rotating the slip retainer screws 23 in the clockwise direction. This action causes the frustro conical tips 28 to move away from contact with the walls of the slip bowl 59 and toward the tubing 65 and terminates contact between the tip sides 32 of the frustro conical tips 28 and the slot sides 11 of the dove tail slots 6, respectively. When the last of the slip retainer screws 23 is rotated in the clockwise direction for a distance of approximately 2 to 2½ complete revolutions, the entire slip assembly 12 falls downwardly under the influence of gravity, as the dove tail slots 6 of the slip segments 2 disengage the frustro conical tips 28 of the slip retainer screws 28, respectively. This action allows the slip assembly 12 to settle in the slip bowl 59 to the position illustrated in FIG. 1. It will be appreciated by those skilled in the art that the slip segments 2 drop in concert to the position illustrated in FIG. 1 because of the retainer ring 21, which loosely joins each of the slip segments together, as illustrated in FIG. 3 of the drawing and as heretofore described. Accordingly, it will be further appreciated that rotation of all but the last one of the slip retainer screws 23 simply loosens all but the last of the slip segments 2 on the frustro conical tips 28, respectively, and the entire slip assembly 12 will not slide into the position illustrated in FIG. 1 until the last one of the slip retainer screws 23 is rotated in the clockwise direction. The tubing running unit is then adjusted to reduce the supporting force on the tubing 65 and as the weight of the tubing 65 in the well is brought to bear on the teeth 15 of the slip segments 2, the teeth 15 penetrate the outer surface of the tubing 65 and the slip assembly 12 supports the tubing 65 in the well. The slip retainer screws 23 are then rotated in the opposite or counter-clockwise direction to retract the slip retainer screws 23 in the tubing head 37 and relocate the frustro conical tips 28 against the sides of the slip bowl 59 and away from the slip assembly 12. The packing screws 44 are then rotated in the clockwise direction to cause the bevelled faces 48 of the packing screw heads 47 to exert pressure on the junk ring face 35 of the upper junk ring 41, which action tightens the packing 42 located between the upper junk ring 41 and the lower junk ring 43, to seal the tubing 65 in the tubing head 37. When this is accomplished, the tubing 65 is then considered to be "packed off" in the tubing head 37 and the pressure of the well is tested above the tubing head 37 to insure that the packing 42 located between the upper junk ring 41 and the lower junk ring 43 is holding the well pressure. The tubing running unit and the blowout preventers are then removed from the tubing head 37. The tubing 65 is then cut at a point about six inches above the tubing head 37, the bottom valve carried by the Christmas tree is flanged to the pack-off flange 38 of the tubing head 37, in conventional fashion and this bottom valve becomes the new master valve. The flow or producing lines are then reattached as required and nitrogen is pumped through the Christmans tree into the severed open end of the tubing 65 to remove the plug from the opposite end of the tubing 65 which extends into the well. The well is then ready to produce hydrocarbons through the bore 60 of the tubing head body 52, the outlet bore 63 of the flanged outlet 55 and through the tubing bore 66 of the tubing 65.

Referring again to FIGS. 3, 4c and 6 of the drawings it will be further appreciated by those skilled in the art that when it is desired to remove the tubing head 37 from the well after depletion, the new master valve carried by the Christmas tree can be first removed from the pack-off flange 38 and the tubing head 37 then removed from the bottom master valve by unbolting the bottom flange 54 from the old master valve flange, in the customary manner. The pack-off flange 38 is then removed from the top flange 53 in the tubing head 37 by removing the stud nuts 58 and the packing screws 44 are adjusted in the counter-clockwise direction to remove the packing screw head 47 from contact with the upper junk ring 41. The upper junk ring 41, packing 42 and the lower junk ring 43 are then removed from the packing bore 51 to expose the slip assembly 12 and threaded studs or eye bolts [not illustrated] are threadably inserted in the slip apertures 18 of the slip segments 2, to remove the slip assembly 12 from the slip bowl 59. The tubing head 37 is then ready to be cleaned and the slip segments 2 reinserted on the frustro conical tips 28 of the slip retainer screws 23, in the manner illustrated in FIG. 2 and heretofore described, for use on another well.

It will be appreciated by those skilled in the art that the tubing anchor assembly of this invention offers many advantages over prior art equipment for inserting tubing, and coiled tubing in particular, in an oil or gas well. Since the working pressure of the well does not need to be neutralized in order to insert the tubing in the well, there is no necessity for using a workover rig or special tools and equipment. Furthermore, the tubing anchor assembly can be used to place tubing in the well under pressure, and under circumstances where terminating the pressure might cause permanent loss of production and where the only alternative to effect continued production is use of a pumping unit, sucker rod string and down hole pump. The tubing anchor assembly of this invention can be used on wells of substantially any depth to support tubing under circumstances where the use of such tubing is feasible. Furthermore, since use of the tubing anchor assembly results in a faster, more efficient insertion of tubing in a well, the operation is rendered safer and less expensive, due to the reduced time of exposure to the well by the operators.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A tubing anchor assembly for supporting tubing in a well comprising tubing support means having an internal bore and a tapered slip bowl in said bore; a plurality of retainer means threadably and radially deployed in said tubing support means in spaced relationship and shaped ends on said retainer means, said shaped ends projecting into said slip bowl; a plurality of slip means disposed in said slip bowl and dove tail slot means provided in said slip means, said slot means engaging said shaped ends on said retainer means, respectively, whereby said slip means are suspended on said shaped ends in a first selected orientation and are released from said shaped ends and dropped into supporting contact with the tubing responsive to threadable rotation of said retainer means in said tubing support means, in a second selected orientation.

2. The tubing anchor assembly of claim 1 further comprising a groove in said slip means and retainer ring means in registration with said groove, whereby said slip means are organized and released in concert from said shaped ends of said retainer means.

3. The tubing anchor assembly of claim 1 further comprising engaging means in said slip means for engaging and supporting the tubing extending through said tubing support means when said slip means are released from said retainer means.

4. The tubing anchor assembly of claim 1 further comprising:

(a) a groove in said slip means and retainer ring means in registration with said groove, whereby said slip means are organized and released in concert from said shaped ends of said retainer means; and (b) engaging means in said slip means for engaging and supporting the tubing extending through said tubing support means when said slip means are released from said retainer means.

5. The tubing anchor assembly of claim 4 wherein said engaging means is a plurality of teeth disposed in said slip means in spaced relationship.

6. The tubing anchor assembly of claim 1 wherein said slip means are each further characterized by a generally wedged-shaped segment having a curved inner surface; parallel inner edges bordering said curved inner surface; a top face and a bottom edge spaced from said top face; and a curved outer surface tapering from said top face to said bottom edge and wherein said dove tail slot means further comprises a slot base disposed in essentially parallel relationship with respect to said parallel inner edges.

7. The tubing anchor assembly of claim 1 wherein said retainer means are each further characterized by an elongated, round shank; shank threads provided on at least a portion of said shank and said shaped ends extending from said shank adjacent said shank threads;

and further comprising frustro conical tips on said shaped ends, said frustro conical tips disposed in registration with said dove tail slot means in said slip means, respectively.

8. The tubing anchor assembly of claim 1 wherein:

(a) said slip means are each further characterized by a generally wedged-shaped segment having a curved inner surface; parallel inner edges bordering said curved inner surface; a top face and a bottom edge spaced from said top face; and a curved outer surface tapering from said top face to said bottom edge and wherein said dove tail slot means further comprises a slot base disposed in essentially parallel relationship with respect to said parallel inner edges; and (b) said retainer means are each further characterized by an elongated, round shank; shank threads provided on at least a portion of said shank and said shaped ends extending from said shank adjacent said shank threads; and further comprising bevelled frustro conical tips on said shaped ends and disposed in registration with said dove tail slot means in said slip means, respectively.

9. The tubing anchor assembly of claim 8 wherein the slot angle of bevel of said dove tail slot means and the tip angle of bevel of said frustro conical tip are substantially equal.

10. The tubing anchor assembly of claim 2 wherein said groove extends laterally across said slip means in substantially perpendicular relationship with respect to said dove tail slot means.

11. The tubing anchor assembly of claim 2 wherein:

(a) said slip means are each further characterized by a generally wedge-shaped segment having a curved inner surface; parallel inner edges bordering said curved inner surface; a top face and a bottom edge spaced from said top face; and a curved outer surface tapering from said top face to said bottom edge and wherein said dove tail slot means further comprises a slot base disposed in essentially parallel relationship with respect to said parallel inner edges;

(b) said retainer means are each further characterized by an elongated, round shank; shank threads provided on at least a portion of said shank and said shaped ends extending from said shank adjacent said shank threads; and further comprising bevelled frustro conical tips on said shaped ends, said frustro conical tips disposed in registration with said dove tail slot means in said slip means, respectively; and (c) said groove extends laterally across said slip means in substantially perpendicular relationship with respect to said dove tail slot means.

12. A tubing anchor assembly for supporting tubing in a well, comprising:

(a) a tubing head and a slip bowl having a tapered, curved wall shaped in said tubing head;

(b) a plurality of retainer screw means radially and threadably disposed in said tubing head with one end of each of said retainer screw means extending into said slip bowl;

(c) a frustro conical tip shaped in said one end of said each of said retainer screw means and disposed adjacent the wall of said slip bowl in a first orientation;

(d) a plurality of generally wedge-shaped slip means disposed radially in said slip bowl and a dove tail slot provided in each of said slip means, said dove tail slot engaging said frustro conical tip of said retainer screw means, respectively, whereby threadable rotation of said retainer screw means in said tubing head extends said slip means away from the wall of the slip bowl and said dove tail slot in said slip means disengages said frustro conical tip and drops into engagement with the slip bowl and the tubing, in a second orientation.

13. The tubing anchor assembly of claim 12 further comprising a groove in said slip means and a retainer ring in said groove for organizing said slip means and causing said slip means to drop in concert from said frustro conical tip to said second orientation.

14. The tubing anchor assembly of claim 12 wherein each of said retainer screw means is further characterized by an elongated, round shank; shank threads provided on said shank and spaced from said frustro conical tip; an O-ring groove provided in said shank between said threads and said frustro conical tip; and an O-ring in said O-ring groove for sealing said shank in said tubing head.

15. The tubing anchor assembly of claim 12 wherein each of said retainer screw means is further characterized by an elongated, round shank; shank threads provided on said shank and spaced from said frustro conical tip; an O-ring groove provided in said shank between said threads and said frustro conical tip; and an O-ring in said O-ring groove for sealing said shank in said tubing head and further comprising a groove in said slip means and a retainer ring in said groove for organizing said slip means and causing said slip means to drop in concert from said frustro conical tip to said second orientation.

16. The tubing anchor assembly of claim 12 wherein said slip means are each further characterized by a generally wedge-shaped segment having a curved inner surface; parallel inner edges bordering said curved inner surface and defining the length of said segment; a top face and a bottom edge spaced from said top face; and a curved outer surface tapering from said top face to said bottom edge and wherein said dove tail slot is shaped in said curved outer surface and includes a slot base disposed in essentially parallel relationship with respect to said parallel inner edges.

17. The tubing anchor assembly of claim 12 wherein:

(a) said slip means are each further characterized by a generally wedge-shaped segment having a curved inner surface; parallel inner edges bordering said curved inner surface and defining the length of said segment; a top face and a bottom edge spaced from said top face; and a curved outer surface tapering from said top face to said bottom edge;

(b) said dove tail slot is shaped in said curved outer surface and includes a slot base disposed in essentially parallel relationship with respect to said parallel inner edges; and (c) said retainer means are each further characterized by an elongated, round shank; shank threads provided on said shank and spaced from said frustro conical tip; an O-ring groove provided in said shank between said threads and said frustro conical tip; and an O-ring in said O-ring groove for sealing said shank in said tubing head and further comprising a groove in said segment and a retainer ring in said groove for organizing said segment and causing said segment to drop in concert from said frustro conical tip.

18. A tubing anchor assembly for suspending a length of tubing in a well comprising:

(a) a tubing head having a central bore receiving the tubing and a tapered slip bowl in said bore; at least two retainer screw means threadably provided in spaced, radial relationship in said tubing head; and a frustro conical tip having a tip bevel shaped in one end of said retainer screw means and extending into said slip bowl; and (b) at least two slip means disposed in said slip bowl and a dove tail slot having a slot bevel shaped in each of said slip means, said dove tail slot engaging said frustro conical tip of said retainer screw means, respectively, whereby said slip means are selectively supported by said retainer screw means and released by said retainer screw means for disposal against the tubing, responsive to threadable advancement of said retainer screw means in said tubing head toward the tubing.

19. The tubing anchor assembly of claim 18 wherein said at least two retainer screw means is a plurality of retainer screw means and said at least two slip means is a plurality of slip means.

20. The tubing anchor assembly of claim 18 further comprising a groove in each of said slip means and a retainer ring having a diameter larger than the floor of said groove disposed in said groove, for loosely organizing said slip means.

21. The tubing anchor assembly of claim 18 wherein said at least two retainer screw means is a plurality of retainer screw means and said at least two slip means is a plurality of slip means and further comprising a groove in each of said slip means and a retainer ring having a diameter larger than the floor of said groove disposed in said groove, for loosely organizing said slip means.

22. The tubing anchor assembly of claim 18 wherein the angle of said tip bevel in said frustro conical tip is substantially equal to the angle of said slot bevel in said dove tail slot.

23. The tubing anchor assembly of claim 18 further comprising a groove in each of said slip means and a retainer ring having a diameter larger than the floor of said groove disposed in said groove, for loosely organizing said slip means and wherein:

(a) said at least two retainer screw means is a plurality of retainer screw means and said at least two slip means is a plurality of slip means; and (b) the angle of said tip bevel in said frustro conical tip is substantially equal to the angle of said slot bevel in said dove tail slot.

24. The tubing anchor assembly of claim 18 wherein:

(a) said slip means are each further characterized by a generally wedge-shaped segment having a curved inner face; teeth provided on said curved inner face and parallel inner edges bordering said inner face; a curved, tapered outer face, said dove tail slot disposed in said tapered outer face; and a slot base in said dove tail slot, said slot base disposed in essentially parallel relationship with respect to said inner edges of said inner face; and (b) said retainer means are each further characterized by an elongated, round shank; shank threads provided on said shank and spaced from said frustro conical tip; an O-ring groove provided in said shank between said threads and said frustro conical tip; and an O-ring in said O-ring groove for sealing said shank in said tubing head and further comprising a groove in said slip means and a retainer ring in said groove for organizing said slip means and causing said slip means to drop in concert from said frustro conical tip to said second orientation.

25. The tubing assembly of claim 24 wherein:

(a) said at least two retainer screw means is a plurality of retainer screw means and said at least two slip means is a plurality of slip means; and (b) the angle of said tip bevel in said frustro conical tip is substantially equal to the angle of said slot bevel in said dove tail slot.

* * * * *